United States Patent [19]

Fast

[11] Patent Number: 4,485,575

[45] Date of Patent: Dec. 4, 1984

[54] PRICE CHANNEL FLAG CLIP

[76] Inventor: Jacob J. Fast, 7561 NW. 9th St., Plantation, Fla. 33317

[21] Appl. No.: 548,240

[22] Filed: Nov. 3, 1983

[51] Int. Cl.[3] ..... G09F 3/18

[52] U.S. Cl. ..... 40/11 R

[58] Field of Search ..... 40/16 R, 16.2, 16.4, 40/11

[56] References Cited

U.S. PATENT DOCUMENTS

| | | | |
|---|---|---|---|
| 2,927,701 | 3/1960 | Lynde | 40/11 R |
| 3,056,572 | 10/1962 | Gelow | 40/11 R |
| 3,530,605 | 9/1970 | Gutterson | 40/11 R |

*Primary Examiner*—Robert Peshock

*Attorney, Agent, or Firm*—Holman & Stern

[57] ABSTRACT

A price channel flag clip supports a display flag or sheet generally perpendicular to a merchandise display shelf. The clip is made from a resilient diecut plastic sheet which is flexed about its longitudinal centerline when supported in the price channel. A primary slit defined in the sheet extends generally perpendicular to the centerline between two through holes in the sheet. A secondary slit extends from each hole to define a flap having one side of the primary slit as its forward edge. The flap is flexible in and out of the lane of the sheet and its leading edge remains unflexed relative to the second side of the primary slit. To insert a display flag, the flap is flexed rearwardly of the channel-supported and flexed sheet to separate the sides of the primary slit. The flag is inserted edge-first into the primary slit, all the way to the through holes, and the flap is released so that the edges of the primary slit engage the flag therebetween.

17 Claims, 4 Drawing Figures

PRICE CHANNEL FLAG CLIP

BACKGROUND OF THE INVENTION

1. Technical Field

The present invention relates generally to supports for merchandise information display cards and, more particularly, to an apparatus which can be mounted on a price channel of a merchandise display shelf to simply and safely receive a display card.

2. Discussion of the Prior Art

It is often desirable, in retail establishments, to mount product information tags or cards so that they may be seen by customers from a distance down an isle between product display shelves. Specifically, in order to "flag" or attract a customer to a sales item, a card describing the sale may be supported so that the plane of the card extends perpendicular to the display shelves. Thusly supported, the printed surfaces of the card face in opposite directions up and down the aisle, thereby attracting the attention of shoppers on either side of the card. Since many display shelves have price moldings or channels at the forward edges thereof, supports for such display cards are conveniently adapted to attach to such price channels. Heretofore, such supports have been made of stamped metal, were relatively expensive, and were difficult to deploy. In many cases, clerks attempting to secure or remove these supports with respect to price channels, or attempting to insert the display flags in the supports, have cut their fingers on the support itself.

OBJECT AND SUMMARY OF THE INVENTION

It is therefore an object of the present invention to provide an inexpensive price channel flag clip which can be safely secured and removed from a price channel and to which a display flag can be safely and simply secured.

It is another object of the present invention to provide a simple price channel flag clip to which a merchandise display flag can be easily secured in an orientation perpendicular to the price channel of a merchandise display shelf.

Still another object of the present invention is to provide a die-cut resiliently flexible plastic sheet having appropriate slits and holes defined therein to permit the sheet to be simply and easily secured to the price channel of a display shelf in flexed condition, and to permit a display flag to be secured to the sheet in an orientation which is perpendicular to the price channel.

In accordance with the present invention, a price channel flag clip is fabricated from an integral die-cut plastic sheet which is flexibly resilient about its longitudinal center line. Two parallel spaced mounting edges of the sheet are parallel to the longitudinal center line and are adapted to be engaged in respective grooves of a price channel such that the sheet flexes to present a convex forward surface. A primary slit is cut in the sheet and extends generally perpendicular to the longitudinal center line. The primary slit terminates at each end in respective spaced-through holes defined in the sheet and aligned in a direction perpendicular to the longitudinal center line. Second and third slits, each extending from a respective through hole on the same side of the primary slit, define a flap with the primary slit. The flap is resiliently flexible in and out of the plane of the sheet and therefore remains substantially unflexed when the sheet is flexed by virtue of its mounting in the price channel. This has the effect of rendering one side of the primary slit flexed with the sheet while the other side of that slit remains unflexed with the flap.

In order to insert a display flag, the flap is flexed towards the price channel to separate opposite sides of the primary slit. The display flag is then inserted edge-first into the primary slit until the edge of the flag is disposed in the through holes. The flap is then released to permit it to engage the display flag between the straight and flexed sides of the primary slit.

BRIEF DESCRIPTION OF THE DRAWINGS

These and other objects, features and many of the attendant advantages of the invention will be better understood upon a reading of the following detailed description when considered in connection with the accompanying drawings, wherein like parts in each of the several figures are identified by the same reference numerals, and wherein.

DESCRIPTION OF THE PREFERRED EMBODIMENTS

Figure 1:
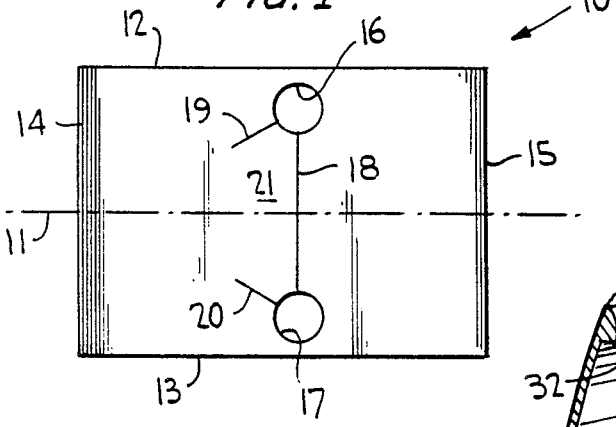
FIG. 1 is a view in plan of a die-cut plastic flag clip of the present invention.

Referring to the drawings in greater detail, a price channel flag clip according to the present invention takes the form of a sheet 10 of resiliently flexible plastic material having a longitudinal centerline 11. A pair of opposite parallel spaced longitudinally-extending edges 12, 13 of the sheet are parallel to centerline 11. A second pair of opposite parallel spaced transversely-extending edges 14, 15 of the sheet are oriented perpendicular to centerline 11. Two through holes 16 and 17 are die-cut into plastic sheet 10 and are disposed on opposite sides of and substantially equidistant from centerline 11. Through holes 16 and 17 are disposed closer to longitudinally-extending edges 12 and 13, respectively, than to the sheet centerline. Although the through holes 16 and 17 are illustrated as being circular, such configuration is merely convenient in the die construction; consequently, these holes can take substantially any configuration consistent with the functional requirements for the holes as set forth in the following description.

A primary slit 18 is die-cut in sheet 10 and extends from hole 16 to hole 17 perpendicular to centerline 11. A second slit 19 extends at one end from through hole 16 and is closed at its other end. A third slit 20 extends at one end from through hole 17 and is closed at its other end. Slits 19 and 20 extend from their respective holes on the same side of primary slit 18 to form a flap or tab 21 which is resiliently flexible in and out of the plane of sheet 10. In order to form this flap 21 slits 19 and 20 preferably extend at an angle between 25° and 90° relative to primary slit 18.

An important aspect of flap 21 resides in the fact that, when sheet 10 is flexed about the centerline 11, the flap does not so flex. Thus, one side of the primary slit 18, namely the side constituting an edge of flap 21, does not flex with sheet 10 about centerline 11, whereas the other side of slit 18 does flex with the sheet.

In the preferred embodiment, longitudinally-extending edges 12 and 13 are 5 cm long, transversely extending edges 14 and 15 are 3.6 cm long, holes 16 and 17 have diameters of 0.6 cm, primary slit 18 is 2 cm long, and slits 19 and 20 are 0.5 cm long. In this embodiment, slits 19 and 20 each subtend an angle of 56° with the primary slit 18.

Figure 2:
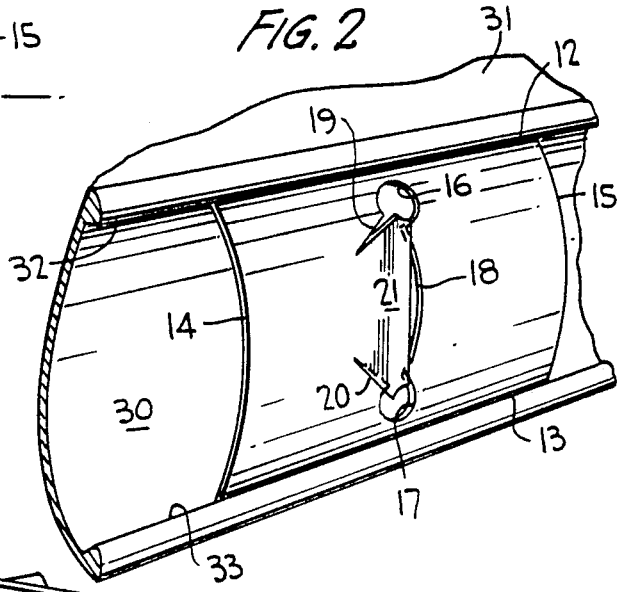
FIG. 2 is a view in perspective of the flag clip of FIG. 1 shown secured to a display shelf price channel.

The integral die-cut flag clip of sheet 10 is deployed on a price channel 30 of a merchandise display shelf 31 in the manner illustrated in FIG. 2. Specifically price channel 30 has a pair of parallel spaced grooves 32, 33 running along its top and bottom edges, respectively. Grooves 32 and 33 are spaced by less than the spacing between longitudinally-extending edges 12 and 13 of sheet 10. The sheet is adapted to be received in price channel 30 by flexing the sheet about its longitudinal centerline 11 and inserting edges 12 and 13 into grooves 32 and 33, respectively. The sheet 10 is thus retained in its flexed or bowed condition in price channel 30. In this condition, the forwardly-presented surface of sheet 10 is convex, as illustrated in FIG. 2. As noted above, flap 21 does not flex with the remainder of sheet 10. Consequently, the side of primary slit 18 which constitutes an edge of flap 21 remains substantially straight while the opposite edge of slit 18 is bowed. The two edges of primary slit 18 thus contact each other only proximate the ends of the slit.

Figure 3:
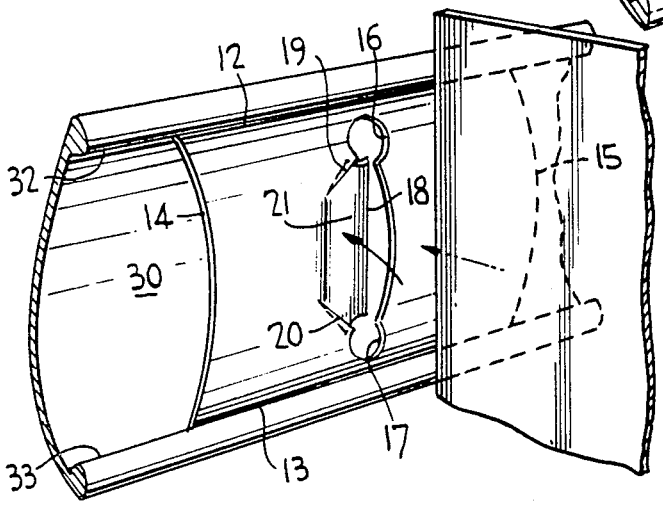
FIG. 3 is a view in perspective, similar to FIG. 2, but showing the flap portion of the flap clip being flexed as part of the flag attachment procedures.

In order to insert a display card or flag 40 into the deployed flag slip, flap 21 is pushed inward toward the price channel 30, as illustrated in FIG. 3. This has the result of opening the primary slit 18 completely because the side of slit 18 which is part of flap 21 is pushed inward and away from the other side of the slit.

Figure 4:
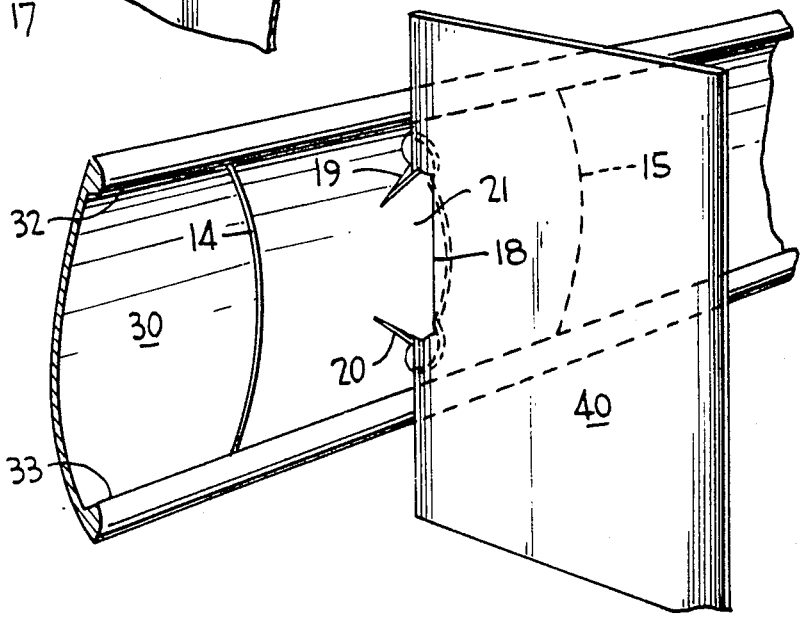
FIG. 4 is a view in perspective similar to FIG. 2, showing a display flag inserted in the price channel-mounted flag clip.

Referring to FIG. 4, with flap 21 held recessed, the display flag or card 40 is inserted edge-first into primary slit 18 as far as the flag will go. Portions of the edge are received in holes 16 and 17. Flap 21 is then released, permitting the sides of slit 18 to return toward one another. However, with the edge of flag 40 inserted in slit 18, the slit slides close on the flag and tightly engage the flag in the slit. As noted above, the sides of primary slit 18 are disposed in registry with one another only proximate their ends, due to the flexure of the sheet 10 without flexure of the flap. Consequently, the display flag 40 is firmly engaged at the ends of the slit in an orientation which is generally perpendicular to the price channel 30.

It will be appreciated that the simple and inexpensive die-cut sheet serves the function of firmly supporting a display flag in a perpendicular orientation relative to the price channel. The clip is inexpensive and, because it is made of resiliently flexible plastic, is easily deplayed and removed from the price channel without causing cuts to the fingers of the person deploying the clip. In addition, the display flag is easily inserted and removed. Removal, of course, is achieved by pressing flap 21 toward the price channel and pulling the flag from the slit 18.

While I have described and illustrated various specific embodiments of my invention, it will be clear that variations from the details of construction which are specifically illustrated and described may be resorted to without departing from the true spirit and scope of the invention as defined in the appended claims.

What is claimed is:

1. A price channel flag clip for use in conjunction with a display structure having a price channel in the form of an elongated surface with elongated parallel first and second grooves disposed on respective sides of said surface, said grooves being spaced by a first predetermined distance, said flag clip comprising:

a sheet of resilient plastic material having a longitudinal centerline and first and second longitudinally-extending edges which are parallel and mutually spaced by a second predetermined distance which is greater than said first predetermined distance, such that said first and second edges may be retained in said first and second grooves, respectively, with said sheet resiliently bulging about said longitudinal centerline to present an exposed convex surface of said sheet forwardly of said structure, said sheet having first and second spaced through holes defined therein, said through holes having respective peripheral edges, said holes being aligned in a direction substantially perpendicular to said first and second edges, said sheet further including a first slit defined therethrough and extending from the peripheral edge of said first hole to the peripheral edge of said second hole, said sheet additionally including second and third slits extending from the peripheral edges of said first and second holes, respectively, on a first side of said slit, said second and third slits being displaced from said first slit at the peripheral edge of said first and second holes, respectively.

2. The flag clip according to claim 1, wherein said second and third slits each subtend an angle of between 25° and 90° with said first slit.

3. The flag clip according to claim 1, wherein said first and second holes are considerably closer to said first and second edges, respectively, than to each other.

4. The flag clip according to claim 1, wherein said first, second and third slits are formed in respective straight line configurations, and wherein said first slit is approximately four times as long as the second and third slits.

5. The flag clip according to claim 1, wherein said second and third slits each subtend respective acute angles with each other and with said first slit.

6. The flag clip according to claim 1, wherein said holes are generally circular, whereby said peripheral edges are circumferential edges, and wherein said second and third slits intersect the circumferential edges of said first and second holes, respectively, at a location which is angularly displaced from the intersection of said circumferential edges with said first slit.

7. The flag clip according to claim 1, wherein said sheet includes a tab defined on first, second and third sides by said first, second and third slits, respectively, said tab being flexible in and out of the plane of said sheet.

8. The flag clip according to claim 7, wherein said first side of said tab remains relatively unflexed when said sheet is caused to bulge about its longitudinal centerline.

9. A price channel flag clip for supporting a thin display card or sheet-like material generally perpendicular to and forwardly of a display structure having a price channel with first and second parallel elongated grooves spaced by a first predetermined distance, said flag clip comprising a sheet of flexibly resilient plastic material having a longitudinal centerline and first and second parallel edges adapted to be retained in said first and second grooves, respectively, and spaced by a distance greater than said first predetermined distance such that said sheet flexes outwardly about its longitudinal centerline when retained at its edges in said grooves, said sheet including flap means formed integrally therewith and having a first edge formed as one side of a first slit defined in said sheet and intersecting said longitudinal centerline, said flap means being flexible out of the plane of said sheet, said flap means having second and third edges in the form of sides of second and third slits defined in said sheet, wherein the flexibility of said flap means relative to said sheet permit said first edge of said flap means to remain substantially straight and unflexed when said sheet is flexed about its longitudinal centerline, and wherein said first slit includes a second side which flexes with said sheet about said longitudinal centerline, whereby said display member may be securely held between the first and second sides of said first slit by fixing the sheet in said price channel to retain the sheet in a flexed condition about its longitudinal centerline such that a convex sheet surface is presented forwardly of said price channel, flexing said flap means rearwardly of said convex surface to separate the first and second sides of said first slit, inserting an edge of said display member into said first slit, and then releasing said flap means to permit the engagement of said display member between the substantially straight first side and the flexed second side of the first slit.

10. The flag clip according to claim 9 further comprising first and second through holes defined in said sheet at the intersections of said first slit through said second and third slits, respectively.

11. The flag clip according to claim 10 wherein said through holes are circular.

12. The flag clip according to claim 10 wherein said second and third slits subtend acute angles with said first slit and converge toward one another in a direction away from said first slit.

13. The flag clip according to claim 12 wherein said first slit extends generally perpendicular to said first and second edges of said sheet.

14. A price channel flag clip comprising a sheet of plastic material having first and second spaced parallel edges and third and fourth spaced edges, first and second through holes defined in said sheet aligned generally perpendicular to said first and second edges, a first slit cut in said sheet and extending from said first hole to said second hole, a second slit cut in said sheet and extending from said first hole to a closed end at an angle from said first slit, and a third slit cut in said sheet extending from said second hole to a further closed end at an angle from said first slit, said second and third slits being cut in said sheet at the same side of said first slit.

15. The flag clip according to claim 14 wherein said first and second through holes are circular.

16. The flag clip according to claim 14 wherein said second and third slits subtend respective acute angles with said first slit.

17. The flag clip according to claim 16 wherein said second and third slits converge toward one another withough intersecting.

* * * * *